US007654179B2

(12) United States Patent
Parrish et al.

(10) Patent No.: US 7,654,179 B2
(45) Date of Patent: Feb. 2, 2010

(54) CRAYON SHARPENER

(75) Inventors: Michael Parrish, Westerville, OH (US); Michael Schumacher, Hilliard, OH (US)

(73) Assignee: Elmer's Products, Inc., Columbus, OH (US)

( * ) Notice: Subject to any disclaimer, the term of this patent is extended or adjusted under 35 U.S.C. 154(b) by 289 days.

(21) Appl. No.: 11/828,544

(22) Filed: Jul. 26, 2007

(65) Prior Publication Data

US 2008/0022538 A1 Jan. 31, 2008

Related U.S. Application Data

(60) Provisional application No. 60/820,375, filed on Jul. 26, 2006.

(51) Int. Cl.
*B26D 1/00* (2006.01)

(52) U.S. Cl. ..... 83/13; 30/452; 30/453; 30/454; 30/457; 30/459

(58) Field of Classification Search ..... 30/451, 30/452, 454, 457, 453, 455, 458, 459; 144/28.5, 144/28.72, 28.1
See application file for complete search history.

(56) References Cited

U.S. PATENT DOCUMENTS

| | | | | |
|---|---|---|---|---|
| 2,691,960 | A | 10/1954 | Leeds et al. | |
| 2,857,881 | A | 10/1958 | Beebe et al. | |
| 3,548,691 | A | 12/1970 | Horrocks | |
| 3,973,604 | A | 8/1976 | Lincoln | |
| 4,050,487 | A | 9/1977 | Mabuchi et al. | |
| 4,248,283 | A | 2/1981 | Kaye | |
| 4,918,816 | A * | 4/1990 | Alpha | 30/452 |
| 4,991,299 | A | 2/1991 | Dietterich et al. | |
| 5,002,182 | A | 3/1991 | McGinnis | |
| 5,167,071 | A | 12/1992 | Eisen | |
| 5,699,620 | A | 12/1997 | Hadtke et al. | |
| 5,802,948 | A | 9/1998 | Andrisin, III et al. | |
| 5,875,555 | A * | 3/1999 | Andrisin et al. | 30/452 |
| 6,065,514 | A | 5/2000 | New | |
| 6,301,791 | B1 * | 10/2001 | Luttgens | 30/454 |
| 6,397,479 | B1 * | 6/2002 | Luttgens | 30/454 |
| 6,470,929 | B2 | 10/2002 | Fregeolle | |
| 6,553,882 | B1 | 4/2003 | Daley, Jr. et al. | |
| 6,886,614 | B2 | 5/2005 | Ricono et al. | |
| 6,944,960 | B2 | 9/2005 | Co | |
| 7,134,461 | B2 * | 11/2006 | Takada | 144/28.72 |
| 7,363,714 | B2 * | 4/2008 | Luttgens | 30/452 |
| 2004/0261275 | A1 | 12/2004 | Fregeolle et al. | |
| 2005/0044730 | A1 | 3/2005 | Fischer | |
| 2005/0138819 | A1 | 6/2005 | Co | |
| 2005/0217125 | A1 | 10/2005 | Fischer | |
| 2005/0257387 | A1 | 11/2005 | Luttgens | |
| 2008/0120848 | A1 * | 5/2008 | Fong et al. | 30/454 |

* cited by examiner

*Primary Examiner*—Jason Daniel Prone
*Assistant Examiner*—Jennifer Swinney
(74) *Attorney, Agent, or Firm*—McNees Wallace & Nurick LLC

(57) ABSTRACT

A device for sharpening crayons, wax pencils, and the like is provided. This device includes: a multi-blade removable and replaceable crayon sharpening cartridge; an electric motor mechanically coupled to the blade cartridge for axially rotating the blade cartridge around a crayon that has been inserted into the blade cartridge; a base for supporting the electric motor; a contoured receptacle positionable on the base beneath the blade cartridge for capturing crayon debris; and a contoured exterior housing for enclosing the electric motor and the blade cartridge.

20 Claims, 14 Drawing Sheets

CRAYON SHARPENER

CROSS-REFERENCE TO RELATED APPLICATIONS

This patent application claims the benefit of U.S. Provisional Patent Application Ser. No. 60/820,375 filed on Jul. 26, 2006 and entitled "Powered Sharpener for Crayons," the disclosure of which is incorporated by reference as if fully rewritten herein.

BACKGROUND OF THE INVENTION

The described invention relates in general to systems and devices for sharpening writing instruments, and more specifically to an electric crayon sharpener that replicates the general appearance of a factory molded crayon prior to the use thereof.

Devices for sharpening writing instruments such as crayons typically include a cone-shaped tapered channel for receiving a unsharpened crayon. The inner wall of this tapered interior channel usually includes a sharpening edge, which may be formed in the wall of the channel or may be provided as a protruding blade that extends from the opening of the channel to the terminal apex thereof. With regard to manual sharpeners, the sharpening edge engages and shaves the exterior surface of the crayon as the crayon is manually rotated in the tapered channel. With regard to powered sharpeners, the sharpening edge is rotated by mechanical means around the crayon. In both cases, the result is that the tip of the crayon is gradually shaved layer by layer into a conical form, tapering more or less to a point.

While being generally effective for their intended purpose, currently available crayon sharpeners suffer from certain performance-related shortcomings. For example, currently available devices are not typically capable of replicating the factory molded tip found on newly purchased crayons. The tips of crayons that have been sharpened to a point with prior art devices quickly deteriorate with use into an undesirable and disappointing dull shape. Also, most art prior devices require that the paper jacket surrounding an unsharpened crayon be removed prior to sharpening. If this paper is not removed, the crayon may not be sharpened at all or the sharpening edges of the sharpener may be quickly dulled. Finally, when the sharpening edges found in most prior art devices wear and become dull, the sharpening edges and/or blades cannot be easily sharpened or replaced. Thus, there is a continuing need for a crayon sharpener that produces an acceptable sharpened tip, while simultaneously and automatically removing the paper sleeve and that has a blade assembly that can be easily and economically replaced to extend the life of the sharpener.

SUMMARY OF THE INVENTION

The following provides a summary of certain exemplary embodiments of the present invention. This summary is not an extensive overview and is not intended to identify key or critical aspects or elements of the present invention or to delineate its scope.

In accordance with one aspect of the present invention, a system for sharpening crayons is provided. This system includes a blade cartridge and mechanical or manual means for either axially rotating the blade cartridge around a crayon that has been inserted into the blade cartridge for sharpening or axially rotating a crayon that has been inserted into the cone-shaped axial bore within the bore. The blade cartridge further includes: (i) a body, wherein the body further includes: a) a first portion having a partially cone-shaped (i.e., a portion of the bore is cylindrical and a portion of the bore is cone-shaped) axial bore passing at least partially through the length thereof; and b) a second portion formed substantially perpendicular to the first portion at one end thereof, and (ii) a first rotary blade mounted on the second portion of the body, wherein the first rotary blade further includes a plurality of chopping teeth formed thereon, and wherein a portion of the first rotary blade extends into the axial bore; (iii) a second rotary blade mounted on the second portion of the body, wherein the second rotary blade further includes a smooth cutting edge formed thereon, and wherein a portion of the second rotary blade extends into the axial bore; (iv) a first planar blade mounted on the first portion of the body substantially parallel to the center axis of the body, wherein at least a portion of the first planar blade extends into the axial bore; and (v) a second planar blade mounted on the first portion of the body at an angle relative to the center axis of the body, wherein at least a portion of the second planar blade extends into the axial bore. Both a front loading and a top loading version of the crayon sharpener of the present invention are described herein.

In accordance with another aspect of the present invention, a mechanical device for sharpening crayons is provided. This device includes: (a) a blade cartridge having the features previously described; (b) an electric motor mechanically coupled to the blade cartridge for axially rotating the blade cartridge around a crayon that has been inserted into the cone-shaped axial bore; (c) a base for supporting the electric motor; (d) a receptacle positionable on the base beneath the blade cartridge; (e) an exterior housing for enclosing the electric motor and the blade cartridge, wherein the exterior housing is adapted both to receive the receptacle and to receive a crayon; and (f) at least one source of electric power.

In yet another aspect of this invention, a method for sharpening a crayon is provided. This method includes (a) providing a blade cartridge having the features previously described; (b) inserting the tip of an unsharpened crayon into the cone-shaped axial bore, wherein the crayon is at least partially wrapped in paper; (c) applying force to the crayon in a direction toward and into the blade cartridge; and (d) rotating the blade cartridge around the crayon while force is being applied thereto, wherein rotating the blade cartridge causes the chopping teeth of first rotary blade to score the paper wrapped around the crayon at multiple points; wherein rotating the blade cartridge causes the smooth cutting edge of the second rotary blade to circumferentially score the paper wrapped around the crayon, wherein rotating the blade cartridge causes the first planar blade to remove the paper wrapped around the crayon from the crayon to form a paperless collar on the crayon, and wherein rotating the blade cartridge causes the second planar blade to shave the end of the crayon into a cone, and wherein the surface of the cone is inset relative to the unsharpened portion of the crayon.

Additional features and aspects of the present invention will become apparent to those of ordinary skill in the art upon reading and understanding the following detailed description of the exemplary embodiments. As will be appreciated by the skilled artisan, further embodiments of the invention are possible without departing from the scope and spirit of the invention. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more exemplary embodiments of the invention and, together with the general description given above and detailed description given below, serve to explain the principles of the invention, and wherein.

DETAILED DESCRIPTION OF THE INVENTION

Figure 1A:
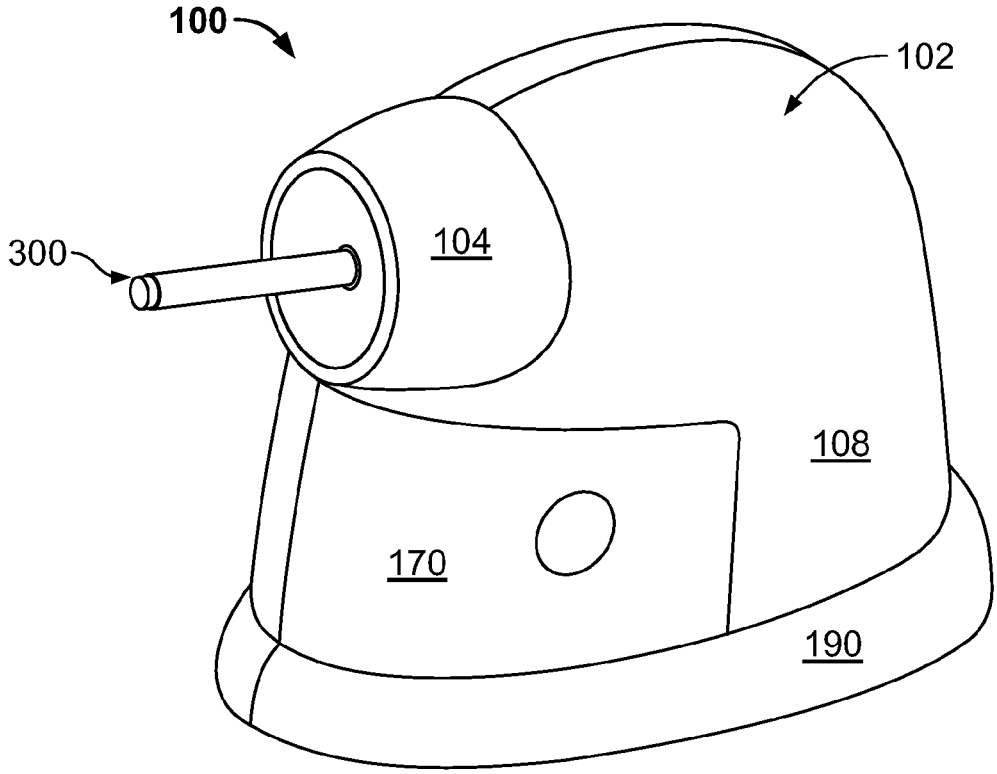
FIG. 1A is a perspective view of an assembled crayon sharpener in accordance with a first exemplary embodiment of the present invention.

Exemplary embodiments of the present invention are now described with reference to the Figures. Reference numerals are used throughout the detailed description to refer to the various elements and structures. In other instances, well-known structures and devices are shown in block diagram form for purposes of simplifying the description. Although the following detailed description contains many specifics for the purposes of illustration, a person of ordinary skill in the art will appreciate that many variations and alterations to the following details are within the scope of the invention. Accordingly, the following embodiments of the invention are set forth without any loss of generality to, and without imposing limitations upon, the claimed invention.

The present invention relates to systems, devices, and methods for sharpening writing implements such as crayons, wax pencils, and the like. As previously indicated, a first general embodiment of this invention provides a system for sharpening a crayon, wax pencil, or similar item; a second general embodiment of this invention provides a powered or manual device for sharpening a crayon; and a third general embodiment of this invention provides a method for sharpening a crayon that has the general appearance of a new, factory-molded crayon. With reference now to the Figures, one or more specific embodiments of this invention shall be described in greater detail.

FIGS. 1A-M provide various illustrative views of a first embodiment of the present invention including and include detailed views of certain components thereof. This "front-loading" embodiment is designed to be a heavy-use or high-volume device for schools, businesses, or other institutions. As best shown in FIG. 1A, an assembled sharpener 100 includes a contoured external housing 102 that further includes front portion 104 and bottom portion 108. Aperture 106 is formed in front portion 104 for receiving crayon 300 and bottom portion 108 is shaped to accommodate receptacle 170, which holds crayon shavings and paper fragments. External housing 102 is attached to base 190 and encloses internal components, which include an electric motor, two activation/deactivation safety switches, an adapter, and a removable and replaceable blade cartridge which is mounted on the adapter. A plurality of non-skid (e.g., rubberized or suction cup) feet is typically attached to the bottom surface of base 190 for securing the crayon sharpener on a surface such as a tabletop or desktop.

Figure 1B:
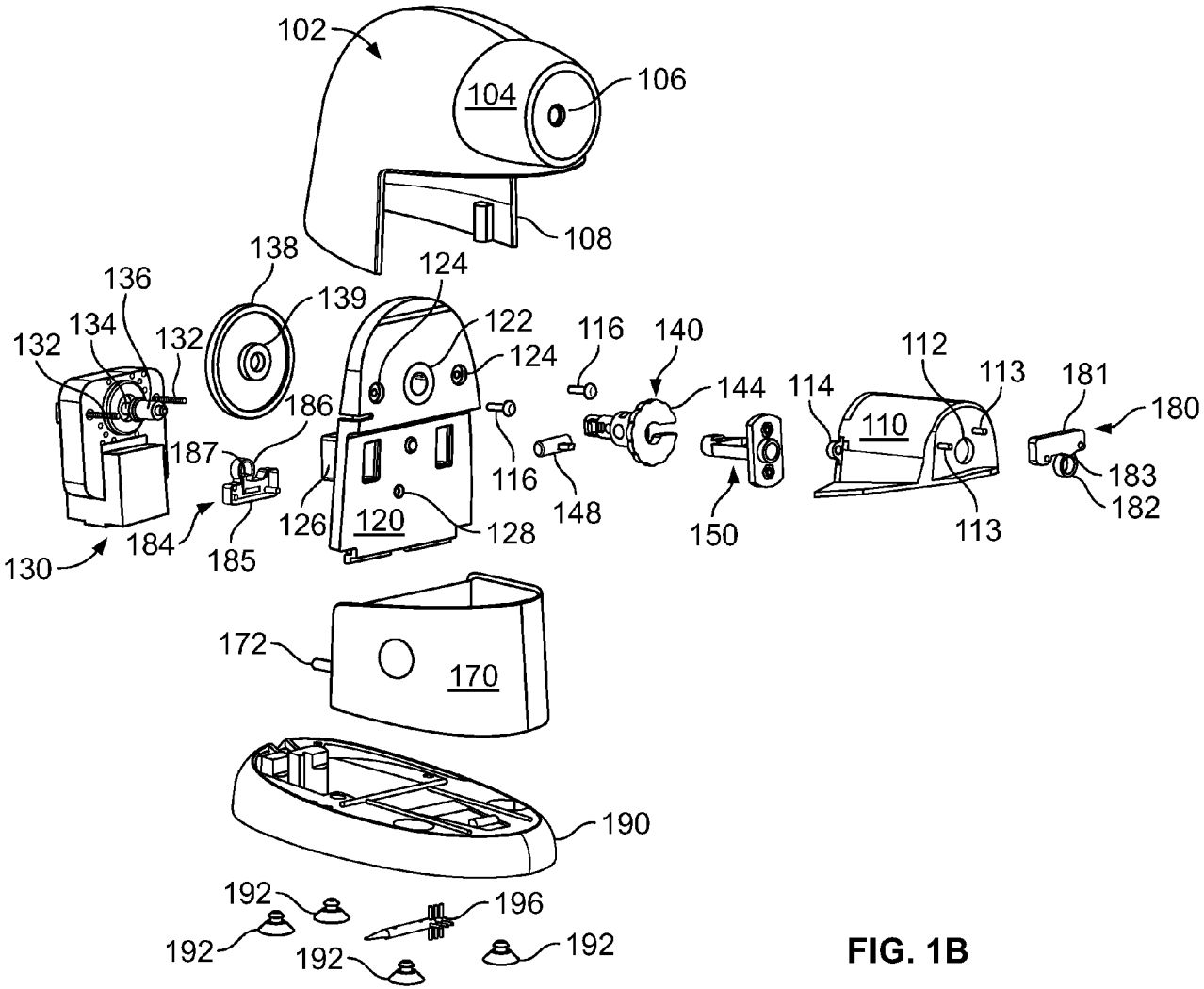
FIG. 1B is an exploded view of the crayon sharpener of FIG. 1A.
Figure 1C:
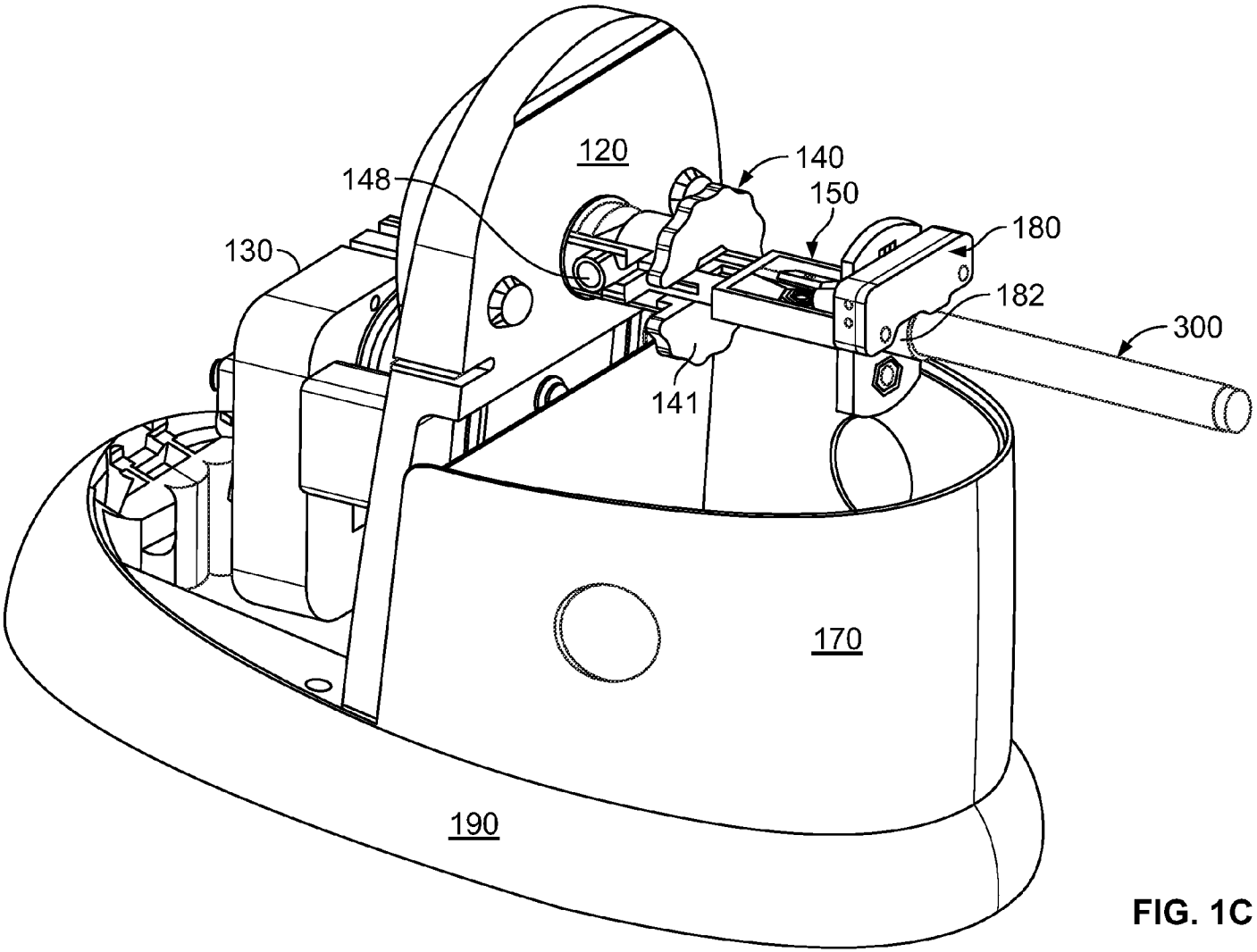
FIG. 1C is a side perspective view of the crayon sharpener of FIG. 1A, wherein the exterior housing has been removed.
Figure 1D:
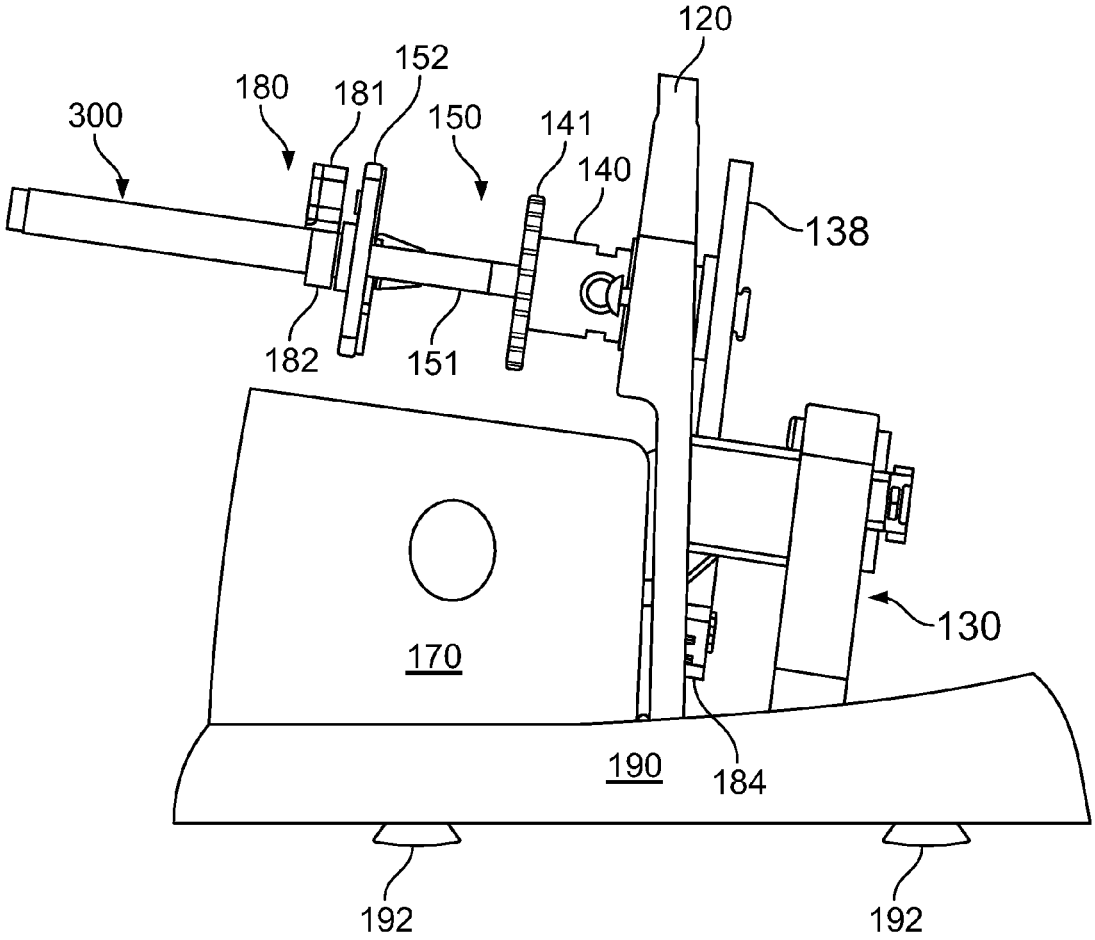
FIG. 1D is a side view of the crayon sharpener of FIG. 1A, wherein the exterior housing has been removed.

FIG. 1B provides an exploded view of the first exemplary embodiment of this invention and illustrates the various external and internal components thereof. As shown in FIG. 1B, crayon sharpener 100 includes internal support 120, which is mounted on base 190. Internal support 120 includes center aperture 122, internal housing mounting apertures 124, motor mounts 126 and drawer switch aperture 128. Motor 130, which is typically electric, rests on base 190 and is connected to internal support 120 by mounting screws 132, which are inserted into motor mounts 126. Motor 130 includes drive shaft 134, upon which first drive gear 136 is mounted. First drive gear 136 is mechanically coupled to second drive gear 138 for transferring mechanical force to adapter 140. Adapter 140 includes finger wheel 141 for manually rotating the adapter, cylindrical body 142, channel 144, adapter shaft 146, and button 148, which further includes an engagement member 149 formed thereon. Button 148 is typically a separately moveable device that is mounted within body 142 such that engagement member 149 extends into channel 144. Adapter shaft 146 extends through aperture 122 in internal support 120 and aperture 139 in second drive gear 138, and is secured thereto by a spring clip, pin, or other mechanical coupling means (see FIGS. 1B-1E).

Blade cartridge 150 includes stem 155, which further includes notch 156 (see FIGS. 1F-K). Blade cartridge 150 may be attached to adapter 140 by moving button 148 to a disengaged position wherein engagement member 149 is recessed partially into body 142, inserting stem 155 into channel 144 such that notch 156 contacts engagement member 149, pulling blade cartridge 150 toward finger wheel 141, using finger wheel 141 to rotate adapter 140 roughly 180°, and depressing button 148 to move engagement member 149 fully into channel 144 and into locking engagement with notch 156. Blade cartridge 150 may be removed from adapter 140 by simply depressing button 148 to disengage notch 156 and engagement member 149 from one another. Other locking means are possible, such as, for example, magnetic locking means or rotate-and-lock means, which typically include interlocking structures or features formed both on the blade carrier and on the adapter.

Figure 1E:
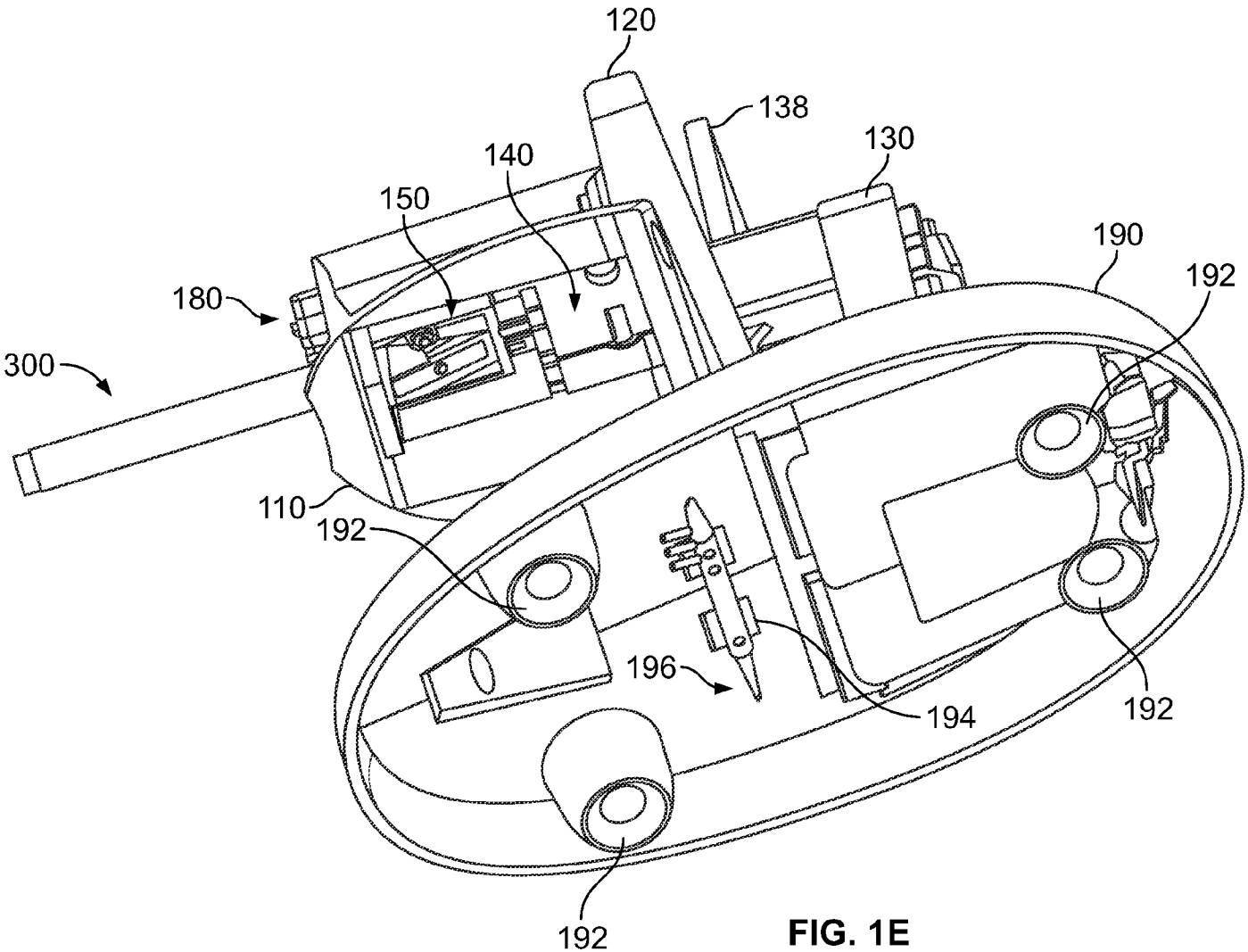
FIG. 1E is a bottom perspective view of the crayon sharpener of FIG. 1A, wherein the exterior housing has been removed.
Figure 1F:
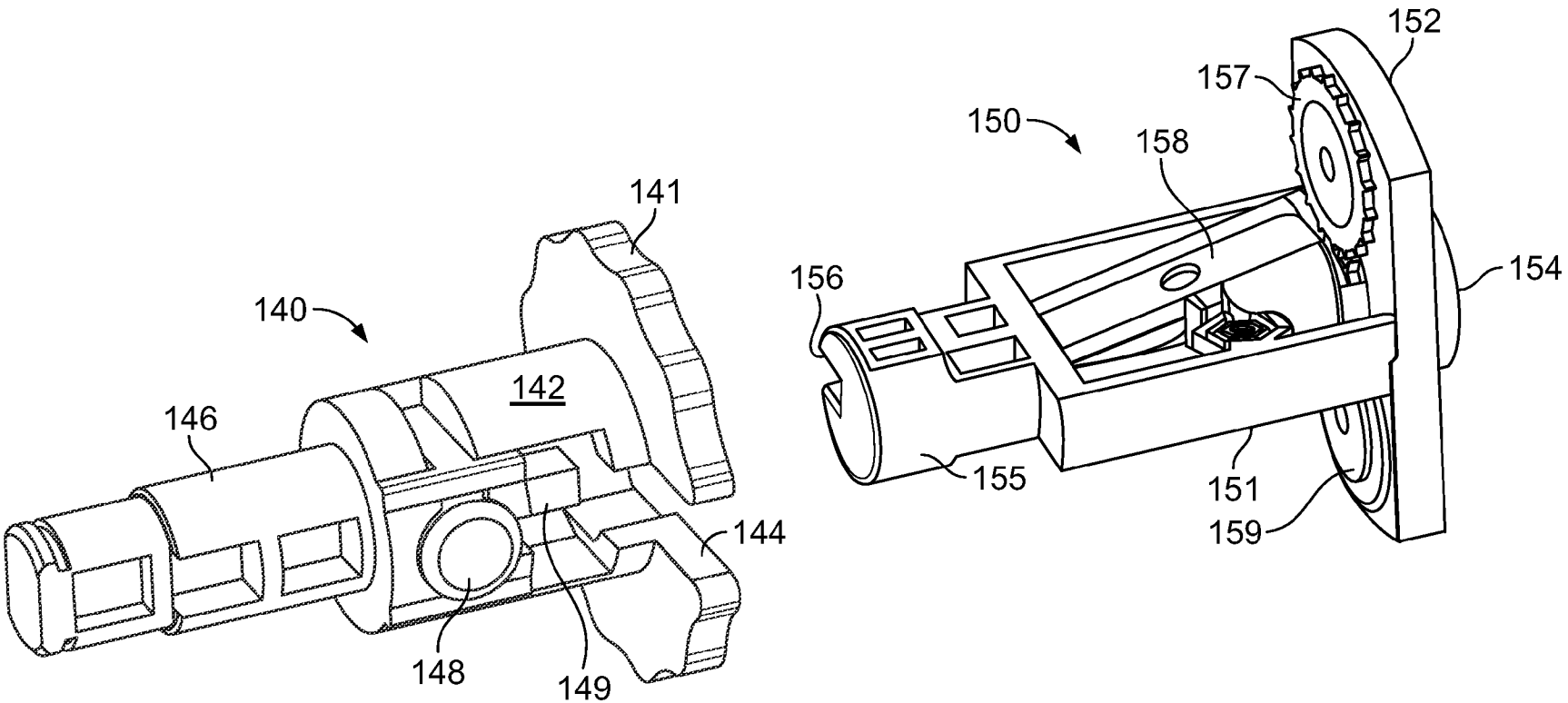
FIG. 1F provides a side perspective view of the adapter and blade cartridge components of the crayon sharpener of FIG. 1A.
Figure 1G:
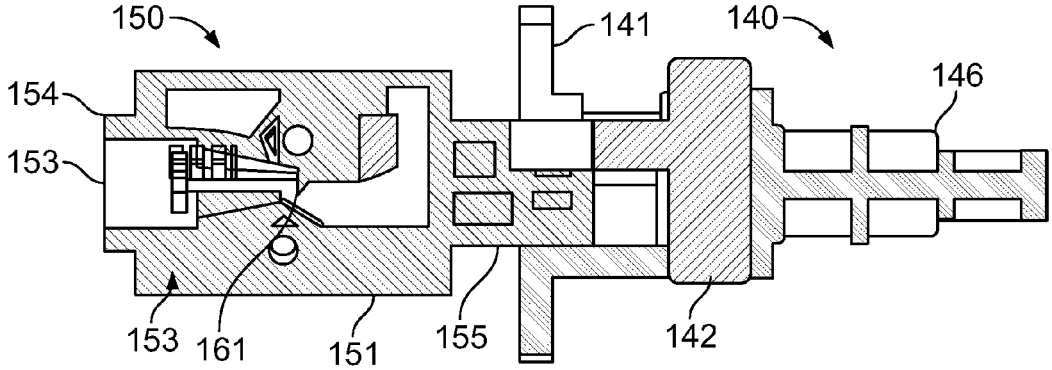
FIGS. 1G-I are multiple views of the adapter and blade cartridge components of the crayon sharpener of FIGS. 1A and 1F, wherein the blade cartridge has been properly inserted into the adapter.
Figure 1H:
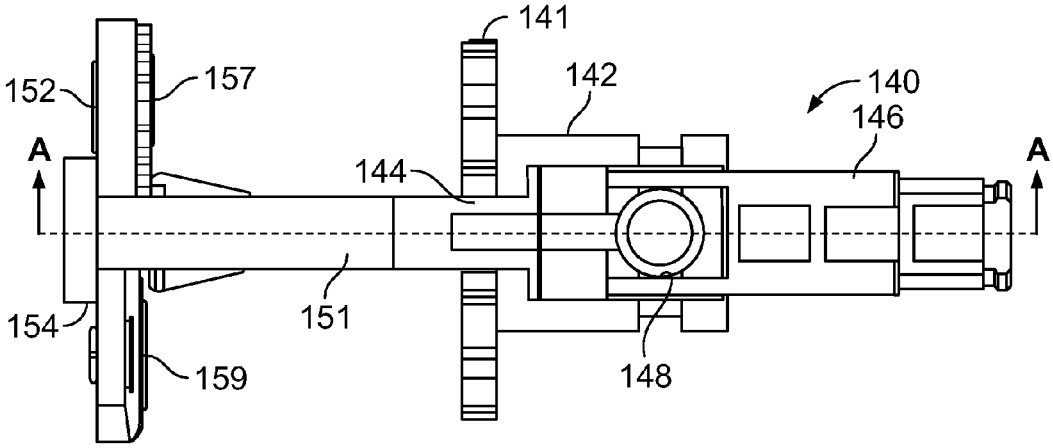
Figure 1I:
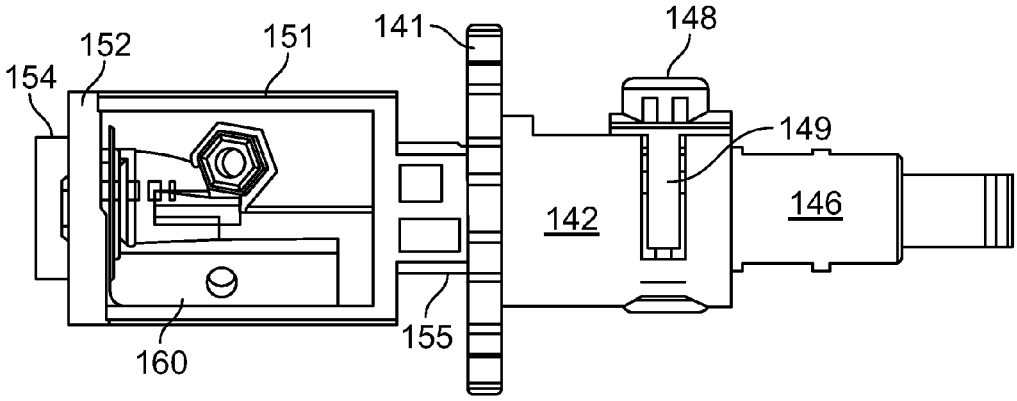
Figure 1J:
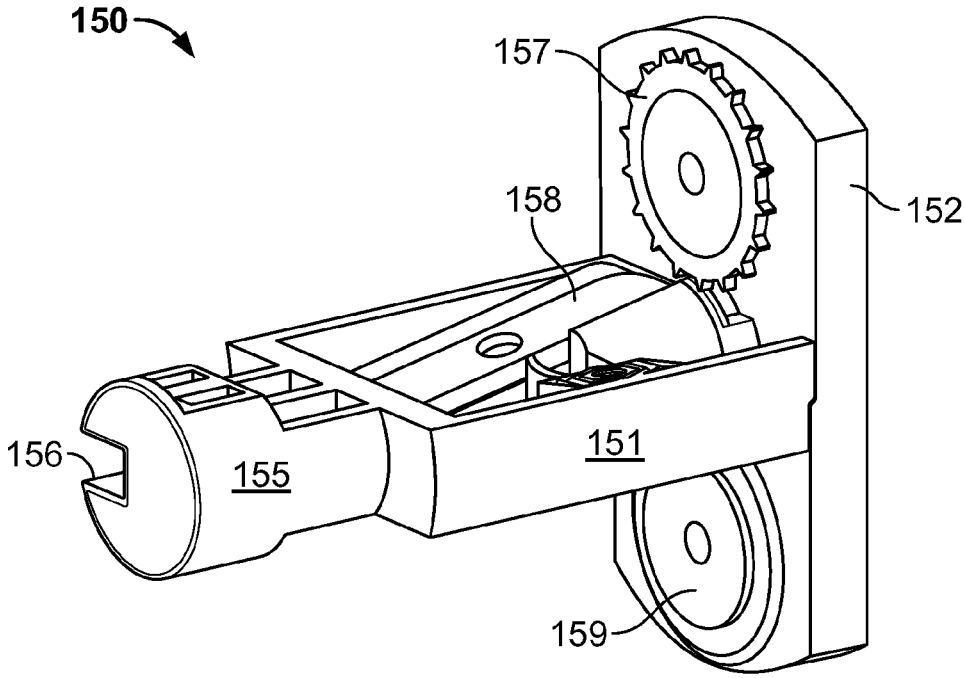
FIGS. 1J-K are two rear perspective views of the blade cartridge component of the crayon sharpener of FIG. 1A showing the relative positions of the blades.
Figure 1K:
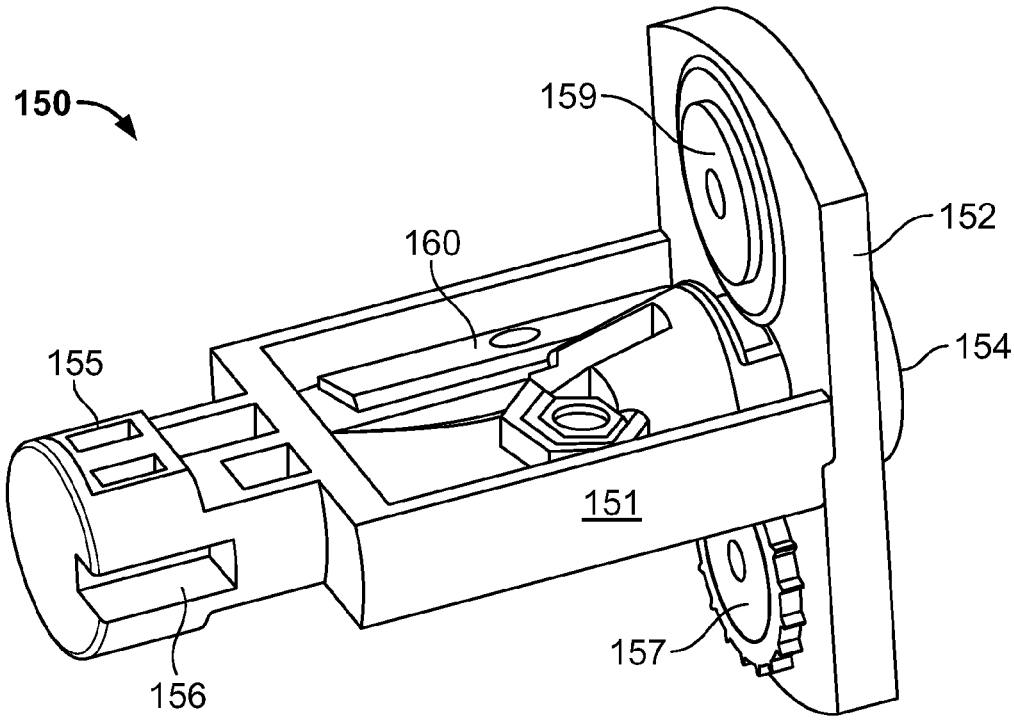
Figure 1L:
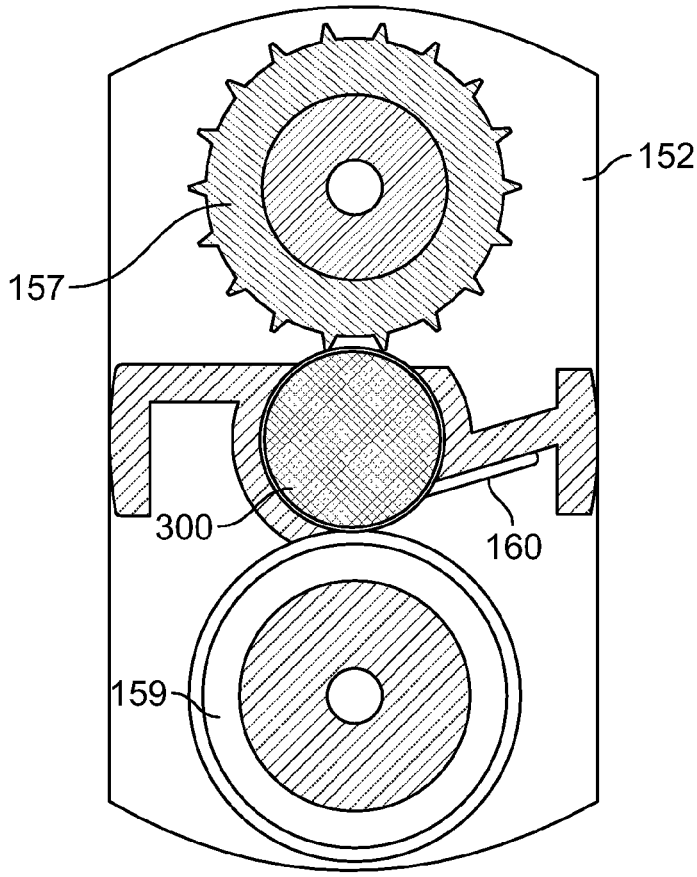
FIG. 1L is a rear cutaway view of the blade cartridge component of the crayon sharpener of FIG. 1A, wherein a crayon has been inserted into the axial bore of the cartridge.

FIGS. 1J-K provide several views of blade cartridge 150, which includes horizontal body portion 151 and vertical body portion 152. A centrally located, partially cone-shaped axial bore 153 is formed in horizontal portion 151 for receiving a crayon in need of sharpening. As shown in FIG. 1G, the outer portion of axial bore 153 is cylindrical in shape and the inner portion of axial bore 153 is substantially cone-shaped. The cone-shaped portion of axial bore 153 terminates in planar stop surface 161, which imparts a flattened nose or tip to a crayon being sharpened with the present invention. A cylindrical collar or lip 154 is formed around the opening of axial bore 153 for insertion into aperture 112 (see below). Rotary paper chopping blade 157 and rotary paper cutting blade 159 are mounted on vertical body portion 152 as shown in FIGS. 1J-K, and planar crayon shaping blade 158 and planar paper peeling blade 160 are mounted on horizontal body portion 151 as shown in FIGS. 1J-K. The rotary blades rotate freely around a central axis when in use and the planar blades remain in a fixed position. A portion of each of the four blades extends into axial bore 153 for making contact with a crayon that has been inserted into axial bore 153. Although the term "blade" is used with reference to the exemplary embodiments, it should be understood that the term "blade" as used herein refers to metal blades as well as any other structure or feature, metal or otherwise, that may operate as a cutting, scoring, chopping, and/or peeling device.

As shown in FIG. 1B, adapter 140 and blade cartridge 150 are enclosed within internal housing 110, which includes center aperture 112, mounting pegs 113, mounting tabs 114, and mounting screws 116. Lip 154 of blade cartridge 150 extends through aperture 112 when crayon sharpener 100 is assembled for providing stability to blade cartridge 150. Switch 180 (see below) is mounted on mounting pegs 113, while mounting screws 116 are inserted through mounting tabs 114 to attach internal housing 110 to internal support 120 at mounting apertures 124.

The exemplary embodiment of the present invention shown in FIGS. 1A-1L includes two switches that affect the operation of crayon sharpener 100. First switch 180 is mounted on the front portion of internal housing 110 and includes switch housing 181, ring 182, and switch 183. As a crayon is inserted through ring 182, switch 183 is depressed, thereby completing the electrical circuit that provides power to motor 130. If switch 183 is not depressed (as when a crayon is not inserted through ring 182) crayon sharpener 100 will not operate. Second switch 184 is mounted on internal support 120 between internal support 120 and motor 130 and includes switch housing 185, ring 186, and switch 187. When receptacle 170 is properly positioned on base 190, peg 172 extends through aperture 128 and ring 186 and depresses switch 187, thereby completing the electrical circuit that provides power to motor 130. If receptacle 170 is removed from base 190, crayon sharpener 100 will not operate. Thus, for crayon sharpener 100 to function properly, a crayon must be inserted into blade cartridge 150 and receptacle 170 must be properly positioned on base 190. Although not shown in the Figures, but as will be appreciated by the skilled artisan, a plurality of electrical wires connects the various electrical components of this embodiment of the present invention.

Figure 1M:
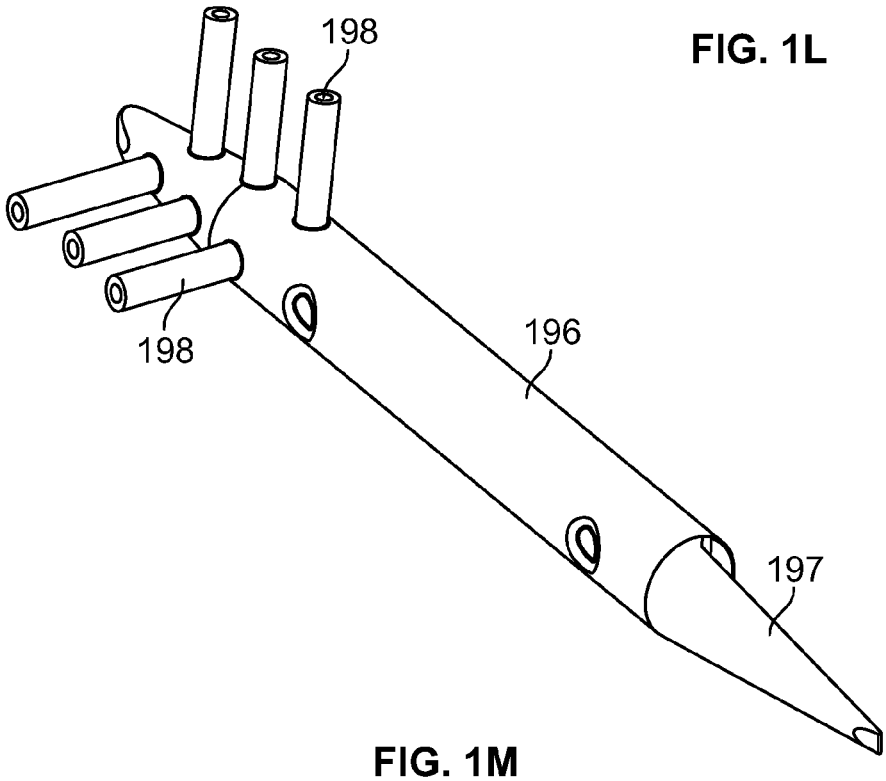
FIG. 1M is a perspective view of the crayon sharpener cleaning device of the present invention.

All embodiments of the present invention may include cleaning brush 196, which is typically stored underneath base 190. As shown in FIGS. 1B, 1E, and 1M, cleaning brush 196 includes tapered end 197 and bristles 198 for removing debris from blade cartridge 150. In the exemplary embodiment shown in FIG. 1E, cleaning brush 196 snaps into brush mounts 194, which are formed in base 190 and may be removed as needed.

Figure 2A:
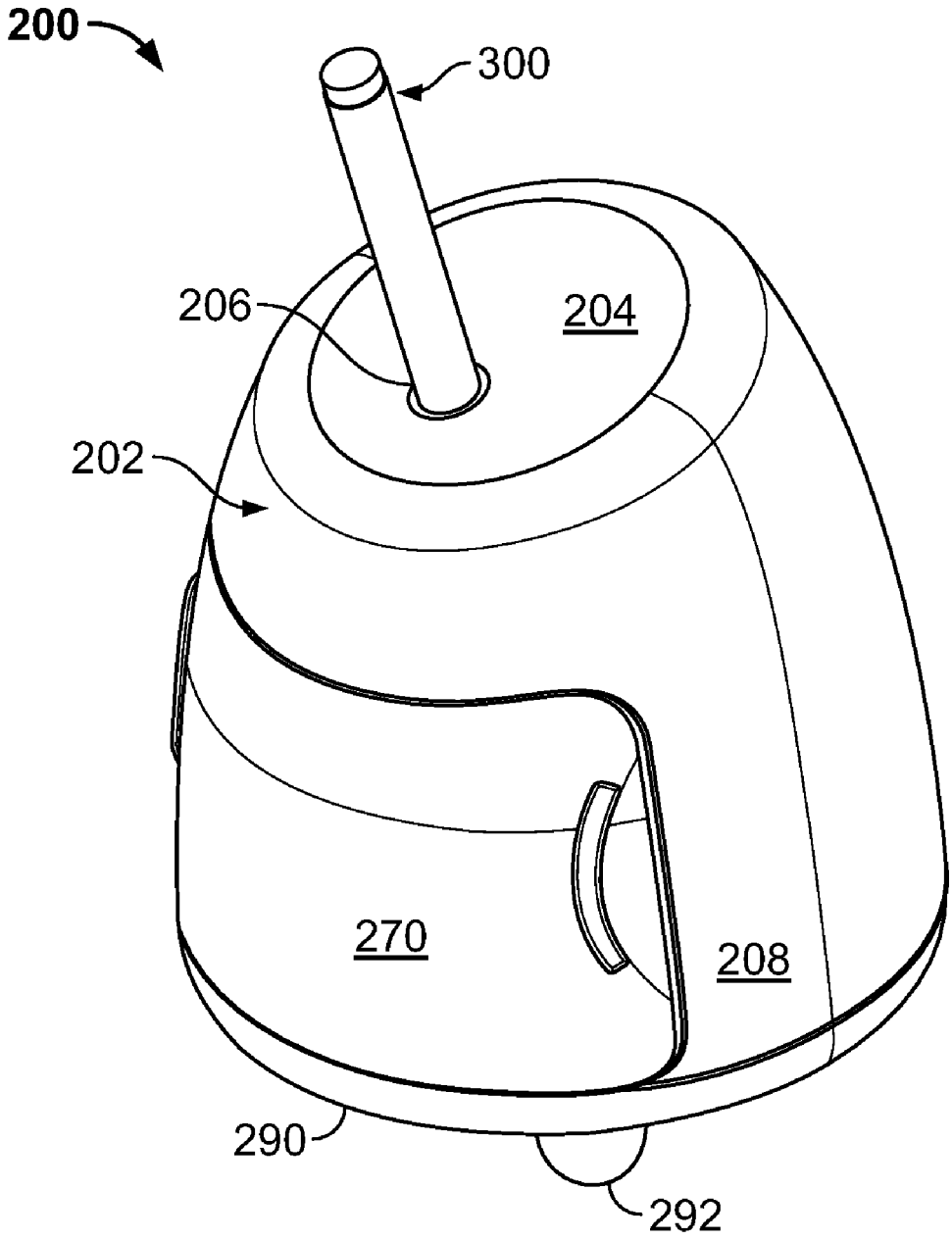
FIG. 2A is a perspective view of an assembled crayon sharpener in accordance with a second exemplary embodiment of the present invention.

FIGS. 2A-D provide various illustrative views of a second embodiment of the present invention including and include detailed views of certain components thereof. This "top-loading" embodiment is designed to be a light-use or relatively low-volume device for home use. As best shown in FIG. 2A, a completely assembled sharpener 200 includes a contoured external housing 202 that further includes top portion 204 and bottom portion 208. Aperture 206 is formed in top portion 204 for receiving crayon 300 and bottom portion 208 is shaped to accommodate receptacle 270, which holds crayon shavings and paper fragments. External housing 202 is attached to base 290 at housing mounts 291 and encloses internal components, which include an electric motor, two activation/deactivation switches, and a blade cartridge. A plurality of non-skid (e.g., rubberized or suction cup) feet is typically attached to the bottom surface of base 290 for securing the crayon sharpener on a surface such as a tabletop or desktop.

Figure 2B:
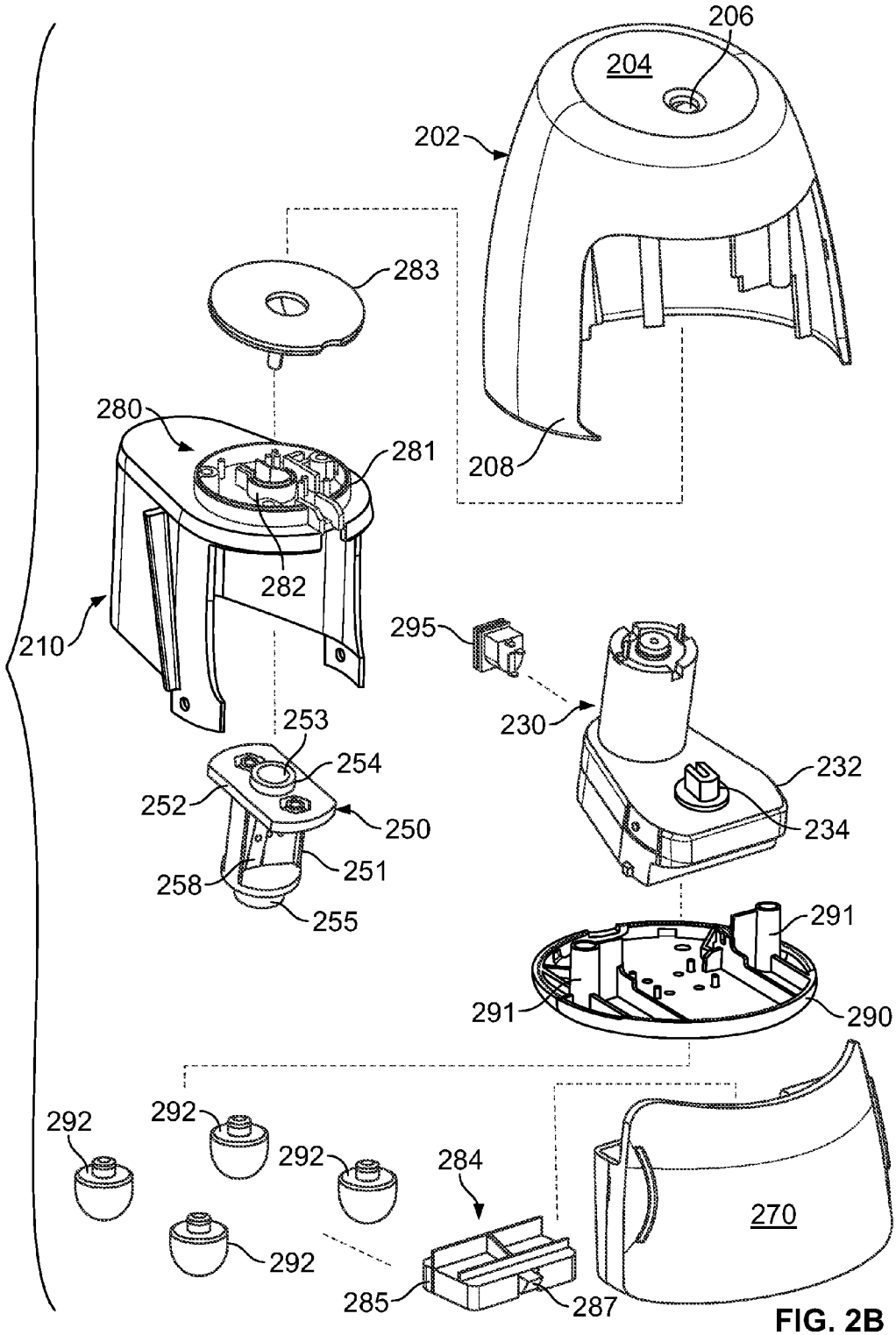
FIG. 2B is an exploded view of the crayon sharpener of FIG. 2A.
Figure 2C:
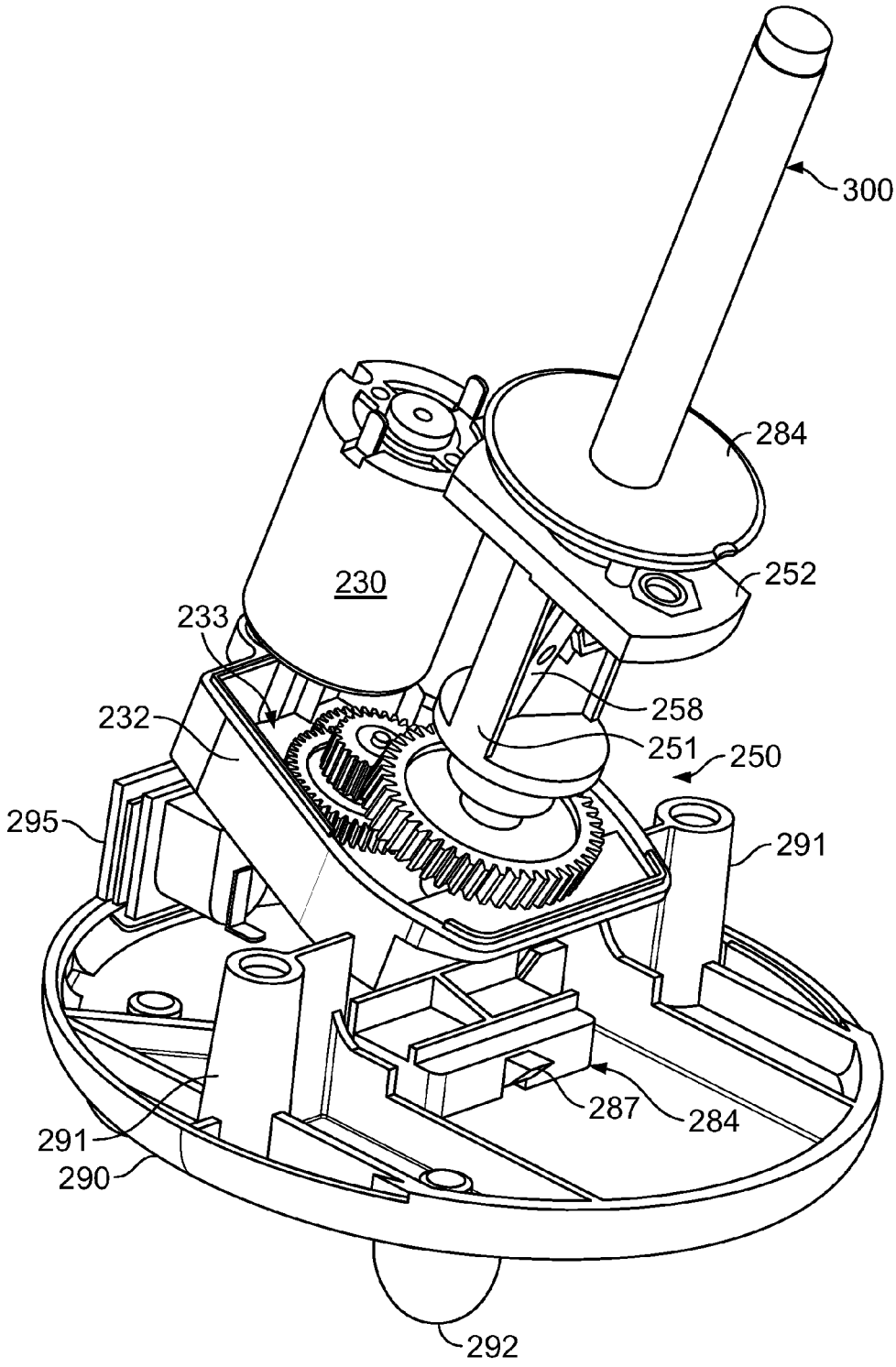
FIG. 2C is a side perspective view of the crayon sharpener of FIG. 2A, wherein the exterior housing has been removed.
Figure 2D:
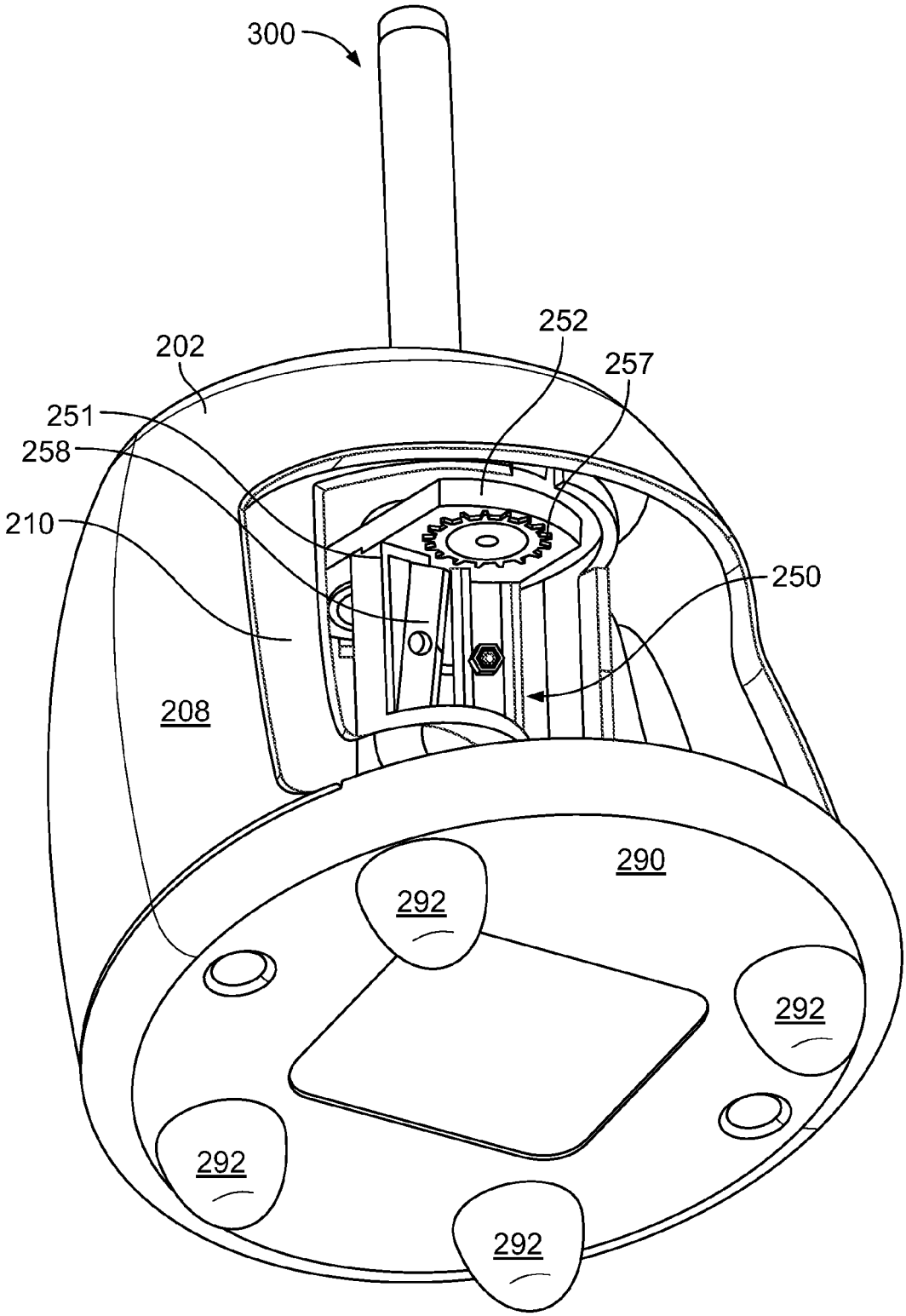
FIG. 2D is a bottom perspective view of the crayon sharpener of FIG. 2A, wherein the receptacle has been removed.

FIG. 2B provides an exploded view of the second exemplary embodiment of this invention and illustrates the external and internal components thereof. As shown in FIG. 2B, crayon sharpener 200 includes internal housing 210, motor 230, and blade cartridge 250. Motor 230, which is typically electric, rests on base 290 and includes gear box 232 which houses the gears of drive train 233 (see FIG. 2C), and drive shaft 234, to which blade cartridge 250 is mechanically coupled at stem 255. In this embodiment, blade cartridge 250 is not removable from crayon sharpener 200. Blade cartridge 250 includes a first or "horizontal" body portion 251 and a second or "vertical" body portion 252. A centrally located, partially cone-shaped axial bore 253 is formed in horizontal portion 251 for receiving a crayon in need of sharpening. The outer portion of axial bore 253 is cylindrical in shape and the inner portion of axial bore 253 is substantially cone-shaped. The cone-shaped portion of axial bore 253 terminates in planar stop surface (not shown), which imparts a flattened nose or tip to a crayon that has been sharpened with the present invention. A cylindrical collar or lip 254 is formed around the opening of axial bore 253 for insertion into an aperture (not shown) formed in the top portion of internal housing 210. Rotary paper chopping blade 257 and a rotary paper cutting blade (not shown) are mounted on vertical body portion 252, and planar crayon shaping blade 258 and a planar paper peeling blade (not shown) are mounted on horizontal body portion 251 as shown in FIGS. 2B-D. The rotary blades rotate freely around a central axis when in use and the planar blades remain in a fixed position. A portion of each of the four blades extends into axial bore 253 for making contact with a crayon that has been inserted into axial bore 253.

The exemplary embodiment of the present invention shown in FIGS. 2A-D includes two safety switches that affect the operation of crayon sharpener 200. First switch 280 is mounted on the top portion of internal housing 210 and includes switch housing 281, ring 282, a switch (not shown), and a disc-shaped cover 283. As a crayon is inserted through ring 282, the switch is depressed, thereby completing the electrical circuit that provides power to motor 230. If the switch is not depressed (as when a crayon is not inserted through ring 282) crayon sharpener 200 will not operate. Second switch 284 is mounted on base 290 and includes switch housing 285 and switch 287. When receptacle 270 is properly positioned on base 290, the rear edge thereof depresses switch 287, thereby completing the electrical circuit that provides power to motor 230. If receptacle 270 is removed from base 290, crayon sharpener 200 will not operate. Thus, for crayon sharpener 200 to function properly, a crayon must be inserted into blade cartridge 250 and receptacle 270 must be properly positioned on base 290. Although not shown in the Figures, but as will be appreciated by the skilled artisan, a plurality of electrical wires connects the various electrical components of this embodiment of the present invention. An AC adapter receptacle 295 is shown in FIG. 2B.

Figure 3:
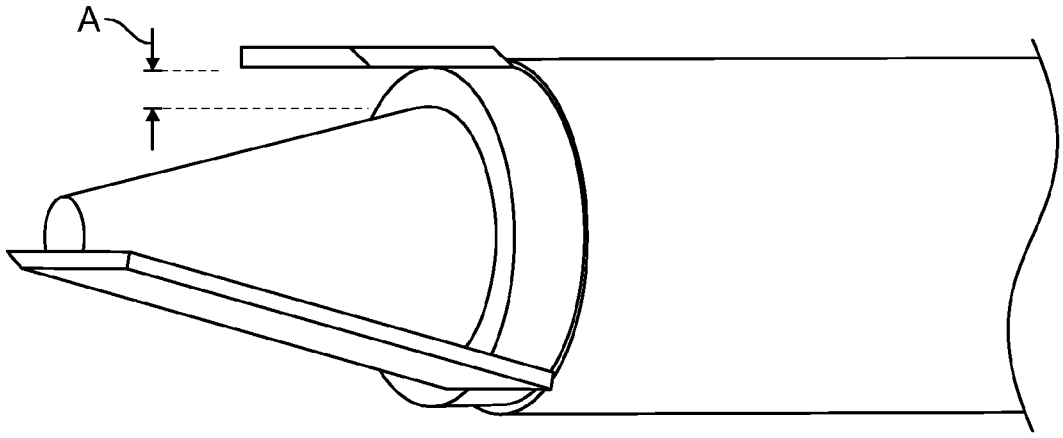
FIG. 3 is a side perspective view of a crayon being sharpened with the crayon sharpener of the present invention.

FIG. 3 illustrates a crayon 300 that has been sharpened by the present invention to very closely resemble a factory-molded crayon. When this invention is in use, the described four-blade cartridge is axially rotated (usually at relatively high speed) around a crayon that has been inserted into the axial bore of the cartridge. By applying directional (e.g., forward or downward) force to the crayon and rotating the blade cartridge axially around the crayon (which includes a paper wrapping), the multiple chopping teeth of the first rotary blade create a plurality of score lines on the paper wrapping in a direction generally parallel to the body of the crayon, the smooth cutting edge of the second rotary blade creates another score line around the circumference of the crayon generally behind the plurality of parallel score lines, the first planar blade removes the scored paper from around the crayon to create a paperless collar on the body of the crayon, and the second planar blade gradually shaves the end of the crayon into a cone, wherein the outer finished surface of the cone is inset relative to the unsharpened portion of the crayon (see distance A in FIG. 3). As a result of the plurality of score lines formed by the chopping teeth, the paper removed from the crayon tends to break up into smaller fragments as it is removed. As previously described, a planar stop surface at the end of the cone-shaped portion of the axial bore creates a flattened tip or nose on the sharpened crayon. As described, the removed paper and shaved crayon material is deposited in a receptacle from which it may later be removed.

In an alternate embodiment of the present invention, the rotary blade that scores the paper wrapping around the body of the crayon is replaced with a straight or planar blade or cutting edge that does not rotate around a central axis point. In another embodiment of this invention, the rotary chopping blade is absent from the blade cartridge, thereby resulting in a three-blade design rather than a four-blade design as described above. In still another embodiment, the first planar blade (i.e., the paper peeling blade) is replaced by a different cutting surface such as a relatively blunt edge or corner formed in or on the cartridge or attached thereto. In still another embodiment, the second portion of the body of the blade cartridge (which is typically perpendicular to the first portion of the body of the blade cartridge) is absent and a planar paper scoring blade is simply mounted on the elongated body of the blade cartridge in an orientation which is generally perpendicular to the axial bore.

While the present invention has been illustrated by the description of exemplary embodiments thereof, and while the embodiments have been described in certain detail, it is not the intention of the Applicant to restrict or in any way limit the scope of the appended claims to such detail. Additional advantages and modifications will readily appear to those skilled in the art. Therefore, the invention in its broader aspects is not limited to any of the specific details, representative devices and methods, and/or illustrative examples shown and described. Accordingly, departures may be made from such details without departing from the spirit or scope of the applicant's general inventive concept.

What is claimed:

1. A system for sharpening crayons, comprising:

(a) a blade cartridge, wherein the blade cartridge further includes:

(i) a body, wherein the body further includes:

a) a first portion further including a partially cone-shaped axial bore passing at least partially through the length thereof; and b) a second portion formed substantially perpendicular to the first portion at one end thereof; and (ii) a first rotary blade mounted on the second portion of the body, wherein the first rotary blade further includes a plurality of chopping teeth formed thereon, and wherein a portion of the first rotary blade extends into the axial bore;

(iii) a second rotary blade mounted on the second portion of the body, wherein the second rotary blade further includes a smooth cutting edge formed thereon, and wherein a portion of the second rotary blade extends into the axial bore;

(iv) a first planar blade mounted on the first portion of the body substantially parallel to the center axis of the body, wherein at least a portion of the first planar blade extends into the axial bore; and (v) a second planar blade mounted on the first portion of the body at an angle relative to the center axis of the body, wherein at least a portion of the second planar blade extends into the axial bore; and (b) means for affecting at least one of axially rotating the blade cartridge around a crayon that has been inserted into the cone-shaped axial bore; and, axially rotating a crayon that has been inserted into the cone-shaped axial bore within the bore.

2. The system of claim 1, wherein the means for axially rotating the blade cartridge further includes an electric motor, and wherein the electric motor is mechanically coupled to the blade cartridge.

3. The system of claim 2, further comprising:

(a) a base for supporting the electric motor;

(b) a receptacle positionable on the base beneath the blade cartridge;

(c) an exterior housing for enclosing the electric motor and the blade cartridge, wherein the exterior housing is adapted both to receive the receptacle and to receive a crayon; and (d) a source of electric power.

4. The system of claim 3, further comprising a cleaning tool mountable within the base, wherein the cleaning tool further comprises a tapered portion and a bristled portion.

5. The system of claim 3, further comprising a first switch positioned near the blade cartridge for activating the motor when a crayon is inserted into the axial bore; and a second switch in contact with the receptacle, wherein the motor is deactivated when the receptacle is removed from the base.

6. The system of claim 3, further comprising an adapter mechanically coupled to the electric motor, wherein the blade cartridge is removably connected to the adapter.

7. The system of claim 3, further comprising at least one crayon to be sharpened.

8. A device for sharpening crayons, comprising:

(a) a blade cartridge, wherein the blade cartridge further includes:

(i) a body, wherein the body further includes:

a) a first portion having a partially cone-shaped axial bore passing at least partially through the length thereof; and b) a second portion formed substantially perpendicular to the first portion at one end thereof; and (ii) a first rotary blade mounted on the second portion of the body, wherein the first rotary blade further includes a plurality of chopping teeth formed thereon, and wherein a portion of the first rotary blade extends into the axial bore;

(iii) a second rotary blade mounted on the second portion of the body, wherein the second rotary blade further includes a smooth cutting edge formed thereon, and wherein a portion of the second rotary blade extends into the axial bore;

(iv) a first planar blade mounted on the first portion of the body substantially parallel to the center axis of the body, wherein at least a portion of the first planar blade extends into the axial bore; and (v) a second planar blade mounted on the first portion of the body at an angle relative to the center axis of the body, wherein at least a portion of the second planar blade extends into the axial bore; and (b) an electric motor mechanically coupled to the blade cartridge for axially rotating the blade cartridge around a crayon that has been inserted into the cone-shaped axial bore;

(c) a base for supporting the electric motor;

(d) a receptacle positionable on the base beneath the blade cartridge;

(e) an exterior housing for enclosing the electric motor and the blade cartridge, wherein the exterior housing is adapted both to receive the receptacle and to receive a crayon; and (f) a source of power for the motor.

9. The device of claim 8, further comprising a cleaning tool mountable within the base, wherein the cleaning tool further comprises a tapered portion and a bristled portion.

10. The device of claim 8, further comprising a first switch positioned near the blade cartridge for activating the motor when a crayon is inserted into the axial bore; and a second switch in contact with the receptacle, wherein the motor is deactivated when the receptacle is removed from the base.

11. The device of claim 8, further comprising an adapter mechanically coupled to the electric motor, wherein the blade cartridge is removably connected to the adapter.

12. The device of claim 11, further comprising mechanical locking means for securing the blade cartridge to the adapter.

13. The device of claim 8, further comprising a plurality of non-slip feet attached to the bottom portion of the base.

14. The device of claim 8, wherein the source of electric power is at least one battery.

15. The device of claim 8, wherein the device is configured to receive a crayon in the top portion thereof.

16. The device of claim 8, wherein the device is configured to receive a crayon in the front portion thereof.

17. A method for sharpening a crayon, comprising:

(a) providing a blade cartridge, wherein the blade cartridge further includes:

(i) a body, wherein the body further includes:

a) a first portion having a partially cone-shaped axial bore passing at least partially through the length thereof; and b) a second portion formed substantially perpendicular to the first portion at one end thereof; and (ii) a first rotary blade mounted on the second portion of the body, wherein the first rotary blade further includes a plurality of chopping teeth formed thereon, and wherein a portion of the first rotary blade extends into the axial bore;

(iii) a second rotary blade mounted on the second portion of the body, wherein the second rotary blade further includes a smooth cutting edge formed thereon, and wherein a portion of the second rotary blade extends into the axial bore;

(iv) a first planar blade mounted on the first portion of the body substantially parallel to the center axis of the body, wherein at least a portion of the first planar blade extends into the axial bore; and (v) a second planar blade mounted on the first portion of the body at an angle relative to the center axis of the body, wherein at least a portion of the second planar blade extends into the axial bore; and (b) inserting the tip of an unsharpened crayon into the cone-shaped axial bore, wherein the crayon is at least partially wrapped in paper;

(c) applying force to the crayon in a direction toward the blade cartridge; and (d) rotating the blade cartridge around the crayon while force is being applied to the crayon, wherein rotating the blade cartridge causes the chopping teeth of first rotary blade to score the paper wrapped around the crayon at multiple points; wherein rotating the blade cartridge causes the smooth cutting edge of the second rotary blade to circumferentially score the paper wrapped around the crayon, wherein rotating the blade cartridge causes the first planar blade to remove the scored paper wrapped around the crayon from the crayon to form a paperless collar on the crayon, and wherein rotating the blade cartridge causes the second planar blade to shave the end of the crayon into a cone, and wherein the surface of the cone is inset relative to the paperless collar.

18. The method of claim 17, wherein the cone-shaped axial bore includes a planar stop surface formed therein, and wherein the planar stop surface imparts a flattened tip to the end of a crayon being sharpened.

19. The method of claim 17, further comprising an electric motor for rotating the blade cartridge around the crayon.

20. The method of claim 17, further comprising manual means for at least one of rotating the blade cartridge around the crayon and rotating the crayon within the blade cartridge.

* * * * *